US011193429B2

(12) United States Patent
Sekita

(10) Patent No.: US 11,193,429 B2
(45) Date of Patent: Dec. 7, 2021

(54) DRIVING CONTROL DEVICE FOR FUEL PUMP AND FUEL SUPPLY APPARATUS

(71) Applicants: MAHLE Electric Drives Japan Corporation, Shizuoka (JP); Mahle International GmbH, Stuttgart (DE)

(72) Inventor: Tomoaki Sekita, Shizuoka (JP)

(73) Assignees: Mahle Electric Drives Japan Corporation; Mahle International GmbH

( * ) Notice: Subject to any disclaimer, the term of this patent is extended or adjusted under 35 U.S.C. 154(b) by 0 days.

(21) Appl. No.: 16/950,833

(22) Filed: Nov. 17, 2020

(65) Prior Publication Data

US 2021/0148292 A1 May 20, 2021

(30) Foreign Application Priority Data

Nov. 18, 2019 (JP) ..... 2019-208040

(51) Int. Cl.
*F02D 1/00* (2006.01)
*F02D 41/30* (2006.01)
(Continued)

(52) U.S. Cl.
CPC ..... *F02D 1/00* (2013.01); *F02D 41/009* (2013.01); *F02D 41/30* (2013.01);
(Continued)

(58) Field of Classification Search
CPC ..... F02D 1/00; F02D 41/00; F02D 41/009; F02D 41/30; F02M 55/025
See application file for complete search history.

(56) References Cited

U.S. PATENT DOCUMENTS 7,289,901 B2 * 10/2007 Kishibata ..... F02D 31/001 307/10.1
2001/0020452 A1 * 9/2001 Suzuki ..... F01P 7/164 123/41.1
(Continued)

FOREIGN PATENT DOCUMENTS

DE 4341948 A1 6/1994
DE 4443879 A1 6/1996
(Continued)

OTHER PUBLICATIONS

English abstract for JP-2011-64127.
German Search Report dated May 11, 2021 for copending German Application No. DE 10 2020 213 306.9.

*Primary Examiner* — John Kwon
*Assistant Examiner* — Johnny H Hoang
(74) *Attorney, Agent, or Firm* — Fishman Stewart PLLC

(57) ABSTRACT

A driving control device for a fuel pump may include a valve-opening-rate calculating unit and a driving control unit. The valve-opening-rate calculating unit may be configured to calculate an injector valve opening rate. The injector valve opening rate may be an injection time of an injector per unit time. The driving control unit may be configured to set a voltage duty ratio of a driving voltage that should be applied to the fuel pump that supplies fuel in a fuel tank to a fuel pipe communicating with the injector. The driving control unit may be further configured to set the voltage duty ratio to a value that is proportional to the injector valve opening rate calculated via the valve-opening-rate calculating unit.

20 Claims, 10 Drawing Sheets

(51) Int. Cl.
*F02M 55/02* (2006.01)
*F02D 41/00* (2006.01)

(52) U.S. Cl.
CPC ... *F02M 55/025* (2013.01); *F02D 2200/0602* (2013.01); *F02D 2200/0618* (2013.01)

(56) References Cited

U.S. PATENT DOCUMENTS

2009/0004517 A1* 1/2009 Nagasaki ..... H01M 8/04447 429/457
2015/0275812 A1* 10/2015 Mori ..... F02D 33/003 123/497

FOREIGN PATENT DOCUMENTS

DE 102012211370 A1 1/2014
JP 2011-64127 A 3/2011

* cited by examiner

DRIVING CONTROL DEVICE FOR FUEL PUMP AND FUEL SUPPLY APPARATUS

CROSS-REFERENCE TO RELATED APPLICATIONS

This application claims priority to Japanese Patent Application No. JP 2019-208040, filed on Nov. 18, 2019, the contents of which is hereby incorporated by reference in its entirety.

TECHNICAL FIELD

The present invention relates to a driving control device for a fuel pump and, more particularly, to a driving control device for a fuel pump that controls a fuel pressure with driving control without including a pressure regulator that adjusts a fuel pump pressure to a fixed pressure.

BACKGROUND

Patent Literature 1 proposes a driving control device for a fuel pump that realizes failsafe control when a fuel sensor is broken down in a fuel supply apparatus including a fuel pressure sensor. The driving control device for the fuel pump performs calibration and creates a 3D map during normal operation and performs map calculation based on the 3D map and controls driving of the fuel pump during fuel pressure sensor fail.

CITATION LIST

Patent Literature

[Patent Literature 1] Japanese Patent Application Laid-Open No. 2011-64127

An example of a 3D map used in a fuel supply apparatus including a fuel pressure sensor is shown in FIG. 9. In the 3D map, an optimum duty ratio of a fuel pump is mapped according to changes in an injection time and rotational speed. In control using the 3D map, a good point and a bad point are that a duty ratio of the fuel pump can be finely controlled according to a mapped value. That is, as a value mapped in the 3D map, a value conforming to actual operation in the fuel supply apparatus is set. Therefore, feedback control can be appropriately performed even when a singular point is present. On the other hand, in such a 3D map, a necessary storage capacity is large and arithmetic processing for map calculation is heavy. Therefore, high-performance requirements are necessary as requirements of a driving control device incorporated in the fuel supply apparatus.

However, it can be said that fine control does not necessarily need to be performed in driving control for the fuel pump during failsafe control. When the driving control for the fuel pump slightly deviates, a fuel pressure is not a desired value. However, this is not a problem from the viewpoint of maintaining an operation state. When the fuel pressure is not the desired value, a fuel injection pressure and a fuel injection amount deviate from desired control and, as a result, an air-fuel ratio deviates from a desired value and fuel efficiency is deteriorated. However, the operation state can be maintained.

Therefore, the present invention has been devised in view of the above problems and an object of the present invention is to provide a driving control device for a fuel pump that can properly control the fuel pump such that an operation state is maintained with a simple configuration without requiring a storage capacity for storing a 3D map and a high processing ability for map calculation.

SUMMARY

In order to solve the problems, a driving control device for a fuel pump according to the present invention is characterized by including: a valve-opening-rate calculating unit that calculates an injector valve opening rate, which is an injection time of an injector per unit time; and a driving control unit that sets a voltage duty ratio of a driving voltage that should be applied to the fuel pump that supplies fuel in a fuel tank to a fuel pipe communicating with the injector, in which the driving control unit sets, as a voltage duty ratio of the driving voltage that should be applied to the fuel pump, a value proportional to the injector valve opening rate calculated by the valve-opening-rate calculating unit.

According to this aspect, by performing driving control for the fuel pump to keep a fuel amount in the fuel pipe constant, it is possible to control a fuel pressure to a fixed pressure without using a pressure regulator and a fuel pressure sensor. Accordingly, it is possible to properly control the fuel pump such that an operation state is maintained without using the pressure regulator and the fuel pressure sensor.

The valve-opening-rate calculating unit may include: a rotation-time acquiring unit that acquires a rotation time of a crankshaft per one air intake; and an injection-time acquiring unit that acquires an injection time of the injector per one air intake. The valve-opening-rate calculating unit may calculate the injector valve opening rate by dividing the injection time of the injector per one air intake acquired by the injection-time acquiring unit by the rotation time of the crankshaft per one air intake acquired by the rotation-time acquiring unit.

According to this aspect, since the valve opening rate is calculated per one air intake, it is possible to perform control at relatively high accuracy even if engine rpm is high or the engine rpm frequently fluctuates.

The injection time of the injector per one air intake may be an injector driving time in which a driving voltage is applied to the injector per one air intake. Note that, when the injector performs injection a plurality of times in one air intake, the injector driving time can be a total of a driving time of the injector required for the injection per one air intake.

According to this aspect, since a control device is capable of grasping, in advance, the injector driving time in which the driving voltage for driving the injector is applied, it is possible to perform control with a simple configuration.

The injection time of the injector per one air intake may be an actual valve opening time obtained by subtracting an ineffective injection time in which, although the driving voltage is applied in one air intake, the fuel is not injected from the injector from the injector driving time in which the driving voltage is applied to the injector per one air intake.

According to this aspect, it is possible to perform more appropriate control considering an actual fuel injection amount.

The unit time may be a fixed value equal to or larger than a rotation time of the crankshaft per one air intake at engine rpm during idling.

According to this aspect, since the unit time is fixed, it is possible to perform control with a simple configuration. Since the valve opening rate is calculated by an average value of injection times in a plurality of times of air intake if the engine rpm increases, it is possible to perform control at relatively high accuracy.

The driving control unit may determine whether a detection result of a fuel pressure sensor, which detects pressure in the fuel pipe, can be used and, when the detection result of the fuel pressure sensor can be used, set, according to the detection result, a voltage duty ratio of a driving voltage that should be applied to the fuel pump and, when the detection result of the fuel pressure sensor cannot be used, execute control for setting, as the voltage duty ratio of the driving voltage that should be applied to the fuel pump, a value proportional to the injector valve opening rate per unit time.

According to this aspect, it is possible to properly control the fuel pump such that the operation state is maintained even during fuel pressure fail. It is possible to properly control the fuel pump such that the operation state is maintained in the fuel supply apparatus having a simple configuration in which the fuel pressure sensor is not provided.

The present invention may provide a fuel supply apparatus including the driving control device for the fuel pump described in any one of the aspects; a rotation time sensor that detects a rotation time of the crankshaft per one air intake; the injector; the fuel pipe; and the fuel pump.

It is possible to provide the fuel supply apparatus that can properly control the fuel pump such that an operation state is maintained without using a pressure regulator and a fuel pressure sensor.

DETAILED DESCRIPTION

In an apparatus that mixes fuel such as gasoline and air and thereafter ignites and burns the fuel and the air, it is possible to control a mixing ratio of the fuel and the air by controlling a fuel injection pressure and a fuel injection time in an injector that injects the fuel. The fuel injection pressure can also be adjusted by a pressure regulator.

Figure 10:
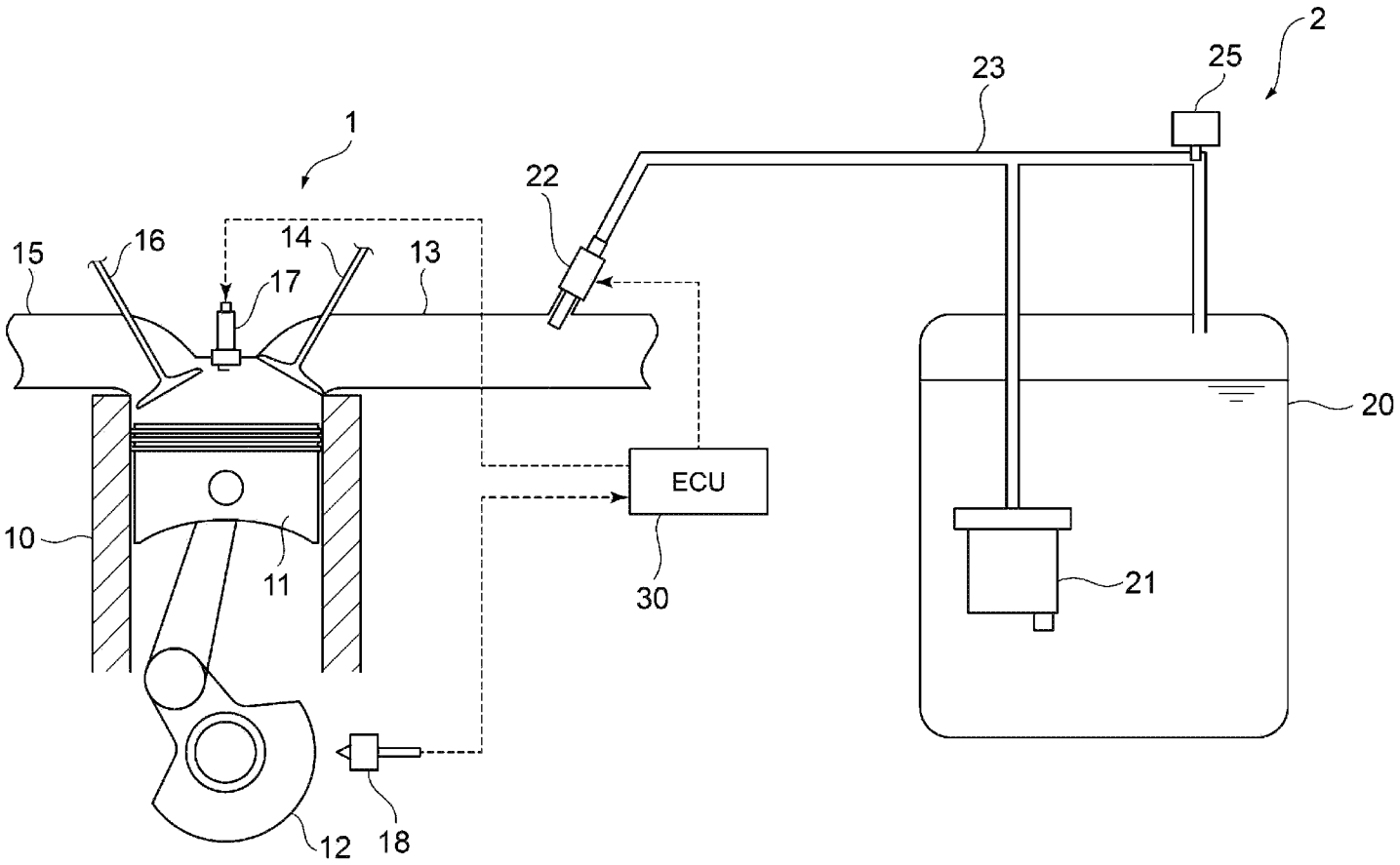
FIG. 10 shows a schematic configuration of an internal combustion engine and a fuel supply apparatus in which a pressure regulator is used.

FIG. 10 shows a fuel supply apparatus 2 including fuel pressure control means using a pressure regulator and an internal combustion engine 1. A pressure regulator 25 shown in FIG. 10 is configured by a mechanical spring and the like. The pressure regulator 25 is provided halfway in a pipe returning to a fuel tank 20 from a fuel pipe 23 connected to an injector 22. The spring closes resisting the pressure in the fuel pipe 23 to confine the fuel in the fuel pipe 23 at a fixed pressure. When a fuel pressure, which is the pressure in the fuel pipe 23, exceeds a predetermined value, the spring opens to return the fuel to the fuel tank 20 until the fuel pressure drops to a predetermined fuel pressure, whereby the fuel pressure is adjusted to a fixed pressure.

There is also known a method of adjusting the fuel injection pressure using a fuel pressure sensor. In this method, the pressure inside a fuel pipe communicating with an injector from a fuel pump is detected by the fuel pressure sensor. Driving of the fuel pump is feedback-controlled to set a detected value to a target fuel pressure.

In the method using the fuel pressure sensor, when the fuel pressure sensor falls into so-called fuel pressure sensor fail, which is a state in which the fuel pressure sensor is broken, the feedback control cannot be performed. It is likely that operation cannot be continued. In order to avoid this, it is necessary to maintain a minimum operation state as failsafe control.

An ECU 30 (see FIG. 2) functioning as the driving control device for the fuel pump explained in this specification includes a fuel-pressure detecting unit 31, a rotation-time acquiring unit 32, an injection-time acquiring unit 33, and a driving control unit 34. The rotation-time acquiring unit 32 acquires a rotation time of a crankshaft per one air intake. The injection-time acquiring unit 33 acquires an injection time of the injector per one air intake. The driving control unit 34 sets a voltage duty ratio of a driving voltage that should be applied to the fuel pump that supplies the fuel in the fuel tank to the fuel pipe communicating with the injector.

In the present embodiment, the rotation-time acquiring unit 32, the injection-time acquiring unit 33, and the driving control unit 34 are equivalent to the valve-opening-rate calculating unit. As an example, the valve-opening-rate calculating unit is explained about a case in which the unit time is set to the rotation time of the crankshaft per one air intake. In this example, the rotation-time acquiring unit 32 and the injection-time acquiring unit 33 respectively acquire a rotation time of the crankshaft per one air intake and an injection time of the injector per one air intake. Further, the driving control unit 34 calculates an injector valve opening rate, which is an injection time of the injector per unit time, by dividing the acquired injection time of the injector per one air intake by the acquired rotation time of the crankshaft per one air intake.

In the example, the unit time is set to the rotation time of the crankshaft per one air intake. However, the unit time may be set to a fixed value equal to or larger than the rotation time of the crankshaft per one air intake at engine rpm during idling.

The driving control unit 34 sets, as a voltage duty ratio of a driving voltage that should be applied to the fuel pump, a value proportional to the injector valve opening rate, which is the injection time of the injector per unit time, obtained by dividing the acquired injection time of the injector per one air intake by the acquired rotation time of the crankshaft per one air intake.

With the driving control device of the fuel pump, it is possible to properly control the fuel pump such that an operation state is maintained with a simple configuration without requiring a storage capacity for storing a 3D map and a high processing ability for map calculation.

Embodiments of the driving control device for the fuel pump are explained in detail below.

FIRST EMBODIMENT

Figure 1:
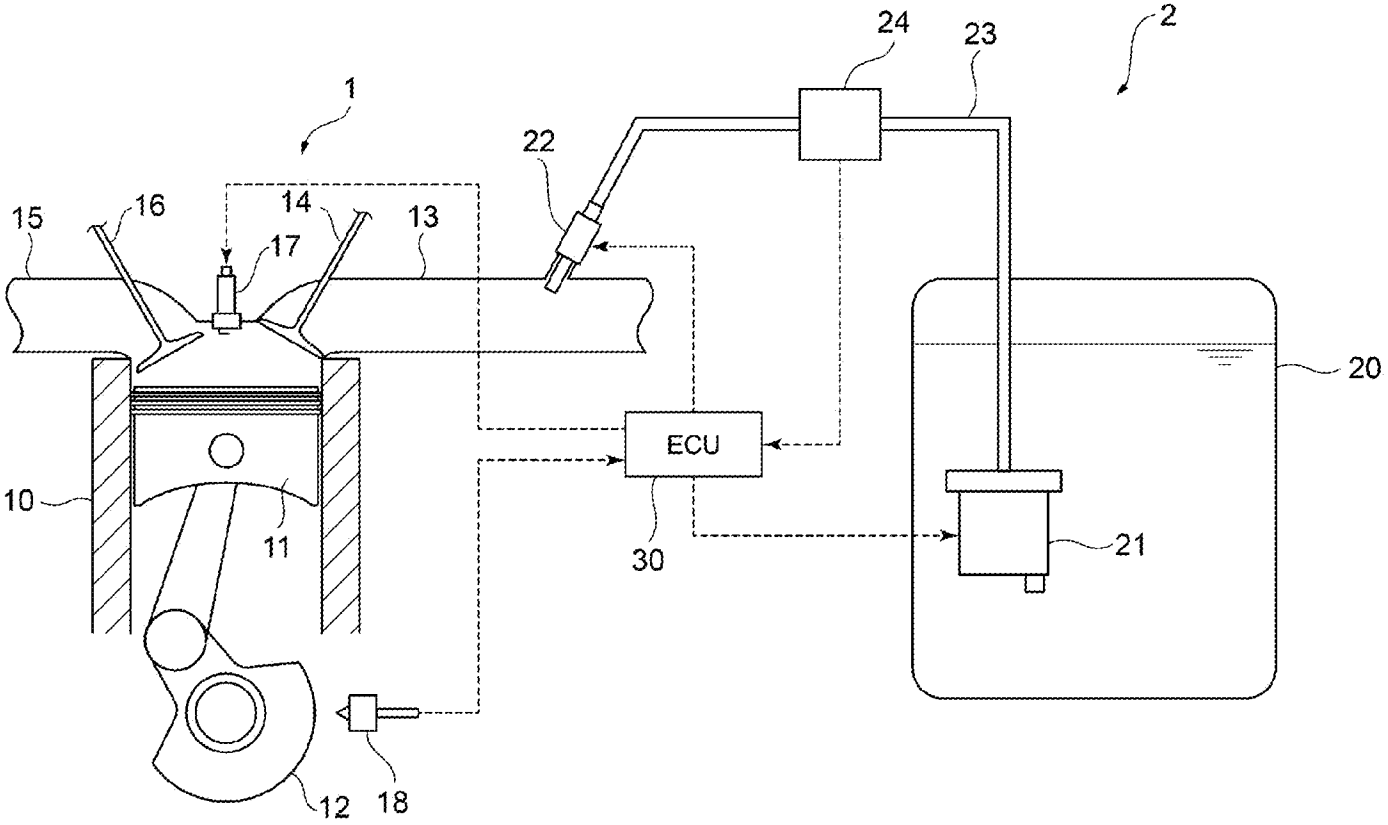
FIG. 1 shows a schematic configuration of an internal combustion engine and a fuel supply apparatus according to a first embodiment.

FIG. 1 shows a schematic configuration of an internal combustion engine 1 and a fuel supply apparatus 2 according to a first embodiment. In the present embodiment, a four-cycle engine is explained as an example. However, the internal combustion engine 1 is not limited to this. The internal combustion engine 1 includes, as shown in FIG. 1, a cylinder 10, a piston 11, a crankshaft 12, an intake pipe 13, an intake valve 14, an exhaust pipe 15, an exhaust valve 16, an ignition device 17, and a pulser 18. The fuel supply apparatus 2 includes, as shown in FIG. 1, a fuel tank 20, a fuel pump 21, an injector 22, a fuel pipe 23, and a fuel pressure sensor 24. The ECU 30 controls the internal combustion engine 1 and the fuel supply apparatus 2 and functions as a driving control device for a fuel pump as well.

The ECU 30 performs driving control of the fuel pump 21 and the injector 22 of the fuel supply apparatus 2 to supply mixed air having a predetermined air-fuel ratio into the intake pipe 13 and controls opening and closing timing of the intake valve 14 and the exhaust valve 16 and ignition timing of the ignition device 17 in the cylinder 10 to control an operation state of the internal combustion engine 1.

The pulser 18 can detect rotation of the crankshaft 12. The pulser 18 sends a detection result to the ECU 30. The ECU 30 can calculate a rotation time of the crankshaft per one air intake from time when the rotation of the crankshaft 12 is detected. In the four-cycle engine, since the crankshaft 12 rotates twice per one air intake, a time in which the rotation of the crankshaft 12 is detected twice can be acquired as the rotation time of the crankshaft per one air intake. The number of revolutions of the engine per unit time can be grasped from the number of revolutions of the crankshaft per unit time of a cylinder forming the engine. The operation state of the internal combustion engine can be grasped according to the engine revolution number per unit time or the like.

The fuel pump 21 is a pump for sucking the fuel in the fuel tank 20 and supplying the fuel to the fuel pipe 23. The fuel pump 21 is turned on and off at a fixed operation cycle. The fuel pump 21 operates based on a pump driving signal received from the ECU 30. Based on a duty ratio set by the pump driving signal, a pump driving voltage is applied and a pump operation is repeated such that a ratio of an ON state and an OFF state becomes a predetermined duty ratio in a fixed operation cycle. Therefore, when a duty ratio with a long ON state is set, a fuel supply amount to the fuel pipe 23 increases. When a duty ratio with a short ON state is set, the fuel supply amount to the fuel pipe 23 decreases. When the fuel pump 21 changes to the ON state, the fuel is introduced into the fuel pipe 23, whereby a fuel pressure, which is an intra-pipe pressure of the fuel pipe 23, rises.

The fuel pressure sensor 24 is a sensor that detects a fuel pressure, which is the pressure in the fuel pipe 23. The fuel pressure sensor 24 outputs the detected fuel pressure to the ECU 30.

The fuel injection valve opens, whereby the injector 22 injects the fuel into the intake pipe 13. For example, an electromagnetic valve can be used as the fuel injection valve. A driving voltage is applied to the injector 22 for an injector driving time designated by a driving signal from the ECU 30, whereby the fuel injection valve is opened and the injector 22 can perform fuel injection. A fuel injection pressure, which is pressure at the time when the injector 22 injects the fuel, can be controlled by a fuel pressure, which is the pressure in the fuel pipe 23. Usually, the pressure in the fuel pipe 23 is adjusted to high pressure. Therefore, the injector 22 can inject the fuel in the fuel pipe 23 into the intake pipe 13 by opening the fuel injection valve adjacent to the intake pipe 13. It is possible to control a state of mixed air formed in the intake pipe 13 by controlling the fuel injection pressure of the injector 22 and an injection time, which is a time in which fuel injection is performed.

In a normal operation state, a target fuel pressure value is determined according to an operation state of the internal combustion engine. A duty ratio of the fuel pump 21 is controlled by the ECU 30, which functions as the driving control device for the fuel pump, such that the fuel pressure in the fuel pipe 23 detected by the fuel pressure sensor 24 converges to the target fuel pressure value. In the control of the fuel pump 21, an injection time of the injector 22 and the like can also be considered.

In this way, in the normal operation state, the duty ratio of the fuel pump 21 can be controlled based on the fuel pressure detected by the fuel pressure sensor 24. Therefore, it is possible to adjust the fuel injection pressure and supply mixed air having a desired air-fuel ratio corresponding to an operation state of the internal combustion engine. However, when the fuel pressure sensor 24 is broken down because of some cause, the control based on the value detected by the fuel pressure sensor 24 cannot be performed. This is a state called fuel pressure sensor fail.

The driving control device for the fuel pump of the fuel supply apparatus in the present embodiment changes, during so-called fuel pressure sensor fail, from control for performing feedback such that the fuel pressure converges to the target fuel pressure value corresponding to the operation state of the internal combustion engine to control for keeping the fuel pressure constant. The fuel pressure is controlled constant without using the fuel pressure sensor 24 by performing driving control of the fuel pump to keep the fuel amount in the fuel pipe 23 constant. Specifically, the fuel amount in the fuel pipe 23 is kept constant by determining and controlling an injection time per one air intake unit of the injector 22 to be a rotation time of the crankshaft in one air intake unit, that is, determining and controlling a duty ratio of the fuel pump 21 to be proportional to an injector valve opening rate per unit time. It is considered that a decrease of the fuel in the fuel pipe 23 due to the fuel injection in the injector 22 can be controlled to be supplemented by the fuel pump 21 by determining and controlling the duty ratio of the fuel pump 21 to be proportional to the valve opening rate of the injector 22 per unit time. The fuel pressure is generally kept constant by keeping the fuel amount in the fuel pipe 23 constant. Consequently, even when the fuel pressure sensor 24 becomes unusable, the fuel pressure in the fuel pipe 23 can be controlled constant.

Figure 2:
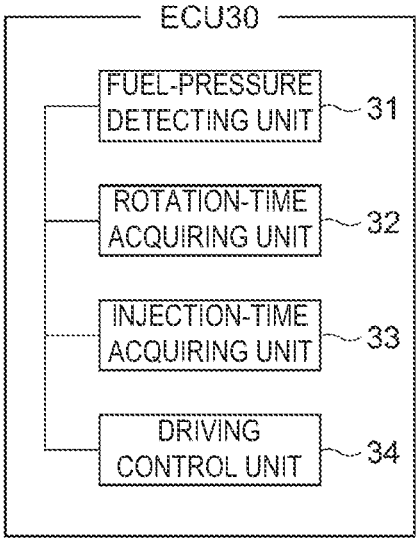
FIG. 2 shows a functional block diagram of an ECU 30 functioning as a driving control device for a fuel pump.

FIG. 2 is a functional block diagram of the ECU 30 functioning as the driving control device for the fuel pump. The ECU 30 includes a fuel-pressure detecting unit 31, a rotation-time acquiring unit 32, an injection-time acquiring unit 33, and a driving control unit 34.

The fuel-pressure detecting unit 31 performs detection of fuel pressure sensor fail based on the fuel pressure in the fuel pipe 23 detected by the fuel pressure sensor 24.

The rotation-time acquiring unit 32 determines a rotation time of the crankshaft per one air intake based on the rotation of the crankshaft detected by the pulser 18 and acquires a determined value.

Figure 3:
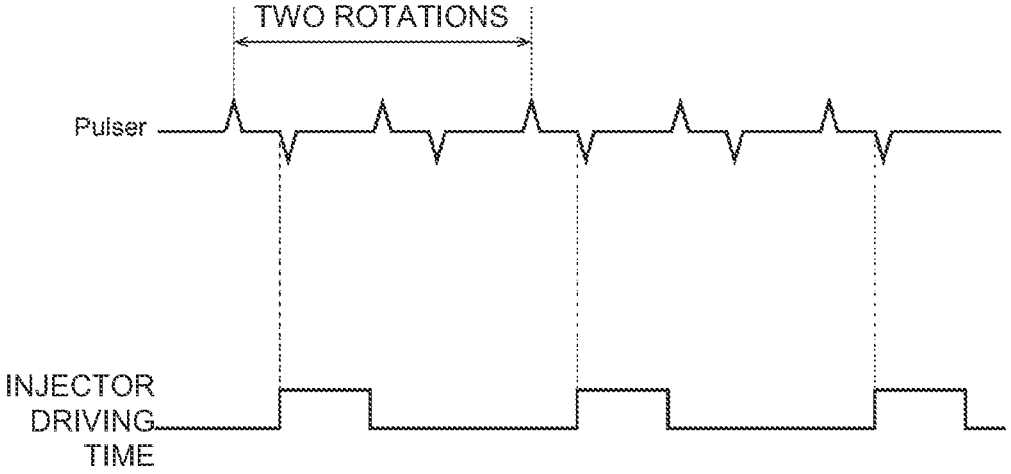
FIG. 3 shows an example of a relation between a detection signal (Pulser) detected by a pulser 18 and a driving time of an injector.

FIG. 3 shows an example of a relation between a detection signal (Pulser) in the pulser 18 and an injector driving time. The pulser 18 detects rotation of the crankshaft 12 by detecting a signal generated by a magnetic flux change at the time when a reluctor provided in a form with varying polarities passes along the circumference of a disc-like flywheel attached to the crankshaft 12. The crankshaft 12 is connected to the piston 11. The rotation of the crankshaft 12 interlocks with movement of the piston 11. Therefore, in the case of a four-cycle engine, it is possible to determine that air intake into the cylinder 10 is performed once by detecting the rotation of the crankshaft 12 twice.

Therefore, the rotation-time acquiring unit 32 acquires, as a rotation time of the crankshaft 12 per one air intake, a time required until a detection signal indicating that the pulser 18 detects that the crankshaft 12 rotates twice is received. In the present embodiment, in the four-cycle engine, the crankshaft rotates twice during one air intake. Therefore, a time required by the crankshaft to rotate twice is acquired as the rotation time of the crankshaft per one air intake. In a two-cycle engine, a time required by a crankshaft to rotate once may be acquired as a rotation time of the crankshaft per one air intake.

As shown as an injector driving time in FIG. 3, it is seen that, in an example of this embodiment, an injector driving voltage for opening a valve of the injector 22 also rises in synchronization with a detection signal in the pulser 18.

In the example shown in FIG. 3, positive pulses and negative pulses of the Pulser continue at a predetermined interval. A required time from a certain positive pulse to the next positive pulse is considered to be a required time of one rotation of the crankshaft 12. One air intake is considered to be performed while this rotation is performed twice. Therefore, a required time of the two rotations is acquired as a rotation required time of the crankshaft per one air intake.

In the example of this embodiment shown in FIG. 3, the injector is also shown as being controlled to be driven at a timing coinciding with the negative pulses of the Pulser.

The injection-time acquiring unit 33 acquires, as an injection time of the injector per one air intake, a time in which the fuel is injected during one air intake. As the injection time, an injector driving time, which is a driving voltage supply time in which a voltage for opening the valve of the injector is applied, can be acquired as the injection time of the injector. The driving voltage supply time fluctuates according to an accelerator opening degree or the like and is determined by the ECU 30 and output to the injector 22. The ECU 30 can acquire, as the injector driving time, the driving voltage supply time output to the injector 22 grasped in advance in this way.

Figure 4:
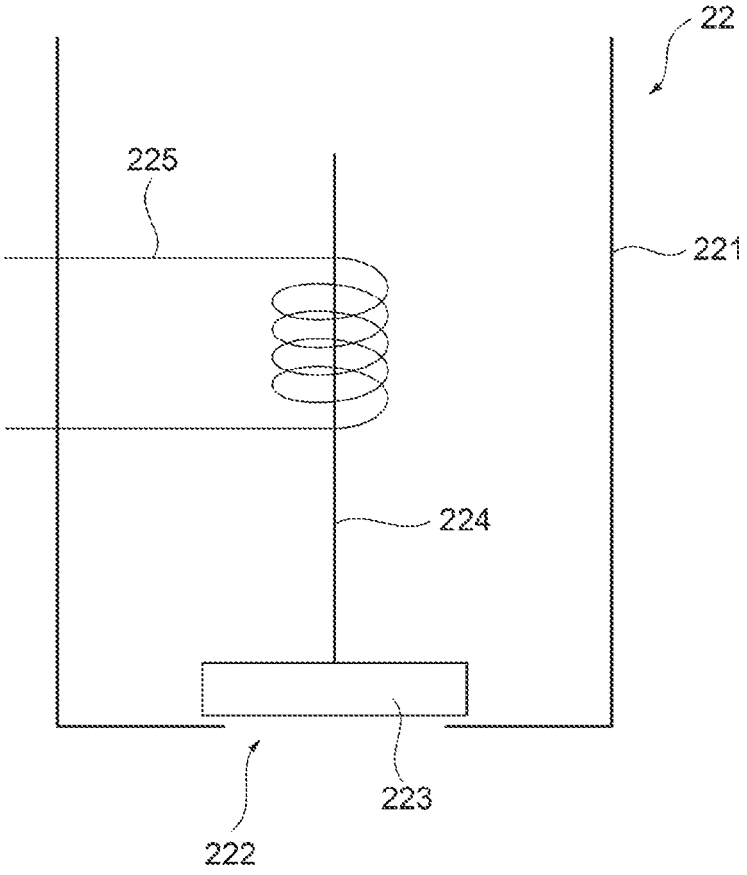
FIG. 4 shows a schematic configuration example of the vicinity of a fuel injection valve of an injector 22.
Figure 5:
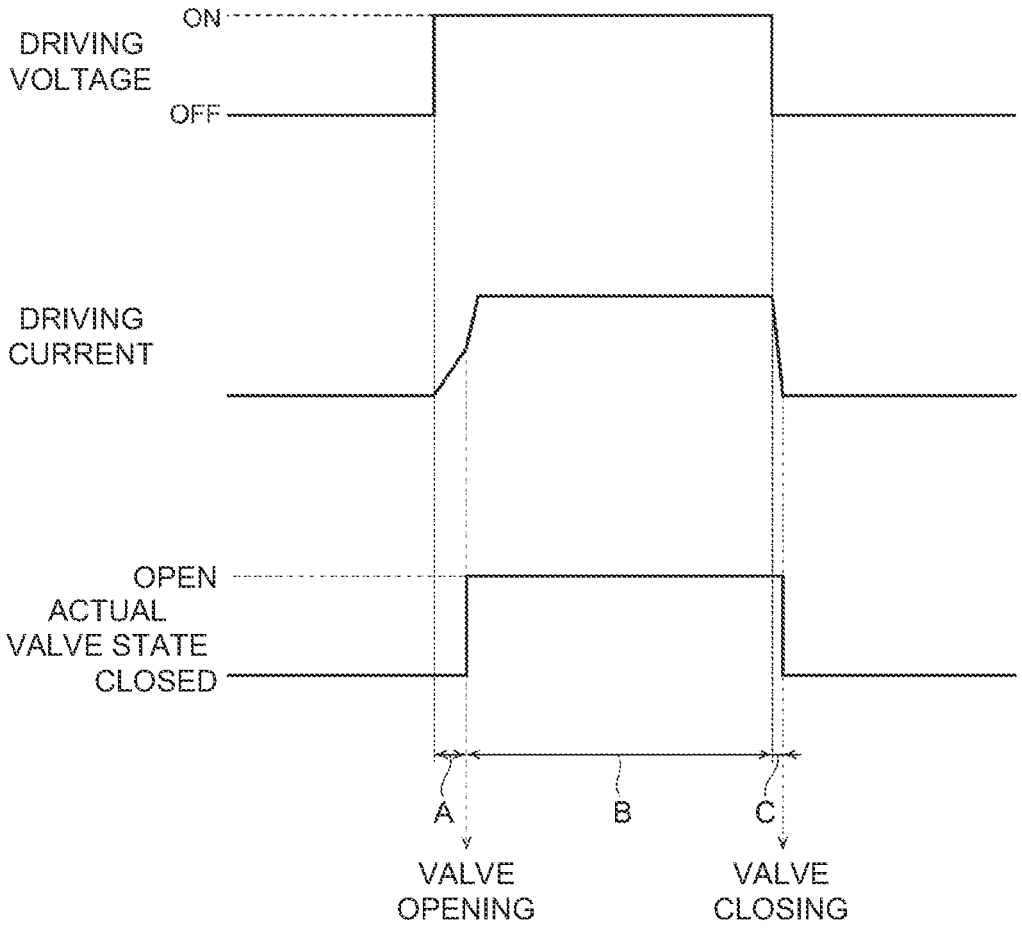
FIG. 5 shows a timing chart showing an example of injector driving timing.

The injection time of the injector is explained. FIG. 4 shows a schematic configuration example of the vicinity of the feel injection valve of the injector 22. FIG. 5 is a timing chart showing an example of injector driving timing.

As shown in FIG. 4, a fuel injection port 222 is provided at the tip of a housing 221 of the injector 22. The fuel injection port 222 is closed by a valve 223. A core 224 on which a coil 225 is wound is fixed and connected to the valve 223. A magnetic flux changes with an electric current generated by applying a driving voltage to the coil 225 and the core 224 moves. The valve 223 moves between an open position and a closed position according to the movement.

In FIG. 5, a driving voltage supplied as a driving signal to the injector 22 and a driving current generated in the coil 225 by the driving voltage are shown. Further, in FIG. 5, an actual valve opening state of the fuel injection valve of the injector corresponding to the driving voltage and the driving current is shown as an actual valve state.

The ECU 30 supplies a voltage pulse shown in FIG. 5 to the injector 22 as an injector driving signal. The length of the voltage pulse of the driving signal (a driving voltage supply time) is an injector driving time. A driving current generated according to the voltage pulse is actually generated slightly later than a rising of the voltage pulse of the driving voltage and decreases slightly later than a falling of the driving voltage. The delay is mainly caused by the inductance of the coil 225.

In this way, the electric current generated in the coil 225 starts to rise slightly later than the rising of the voltage pulse of the driving voltage. Therefore, as shown in FIG. 5 as the actual valve state, the fuel injection valve opens slightly later than the rising of the voltage pulse of the driving voltage. The delay appears as a difference A between an application start time of the driving voltage and a valve opening time. Similarly, as shown in FIG. 5 as the actual valve state, the fuel injection valve during valve closing is closed slightly later than the falling of the voltage pulse of the driving voltage. The delay appears as a difference C between an application end time of the driving voltage and a valve closing time. In this specification, a time (A-C) generated by these delays is defined as an ineffective injection time.

In the ineffective injection time (A-C), although the driving voltage is applied, since the fuel injection valve is in the closed state and the fuel is not injected, the fuel in the fuel pipe 23 substantially does not decrease. Therefore, by calculating an injector driving time in one air intake unit with a time B, which obtained by subtracting the ineffective injection time from the injector driving time, set as the actual valve opening time, it is possible to perform more appropriate control considering the actual fuel injection amount. Note that the calculated injector driving time in one air intake unit is considered to be proportional to a fuel amount that decreases from the fuel pipe 23 per one air intake because of the fuel injection.

The driving control unit 34 calculates an injector valve opening rate, which is an injection time of the injector per predetermined unit time, from the acquired rotation time of the crankshaft per one air intake and injection time of the injector per one air intake.

Further, the driving control unit 34 sets, to a value proportional to the calculated injector valve opening rate per unit time, a voltage duty ratio of a pump driving signal for driving the fuel pump that supplies the fuel in the fuel tank to the fuel pipe 23 communicating with the injector 22. Specifically, the driving control unit 34 can set the voltage duty ratio of the pump driving signal to a value obtained by multiplying the injector valve opening rate per unit time by a predetermined correction coefficient. The correction coefficient can be set in advance according to a fuel supply ability of the fuel pump 21 and a fuel injection ability of the injector 22.

Figure 6:
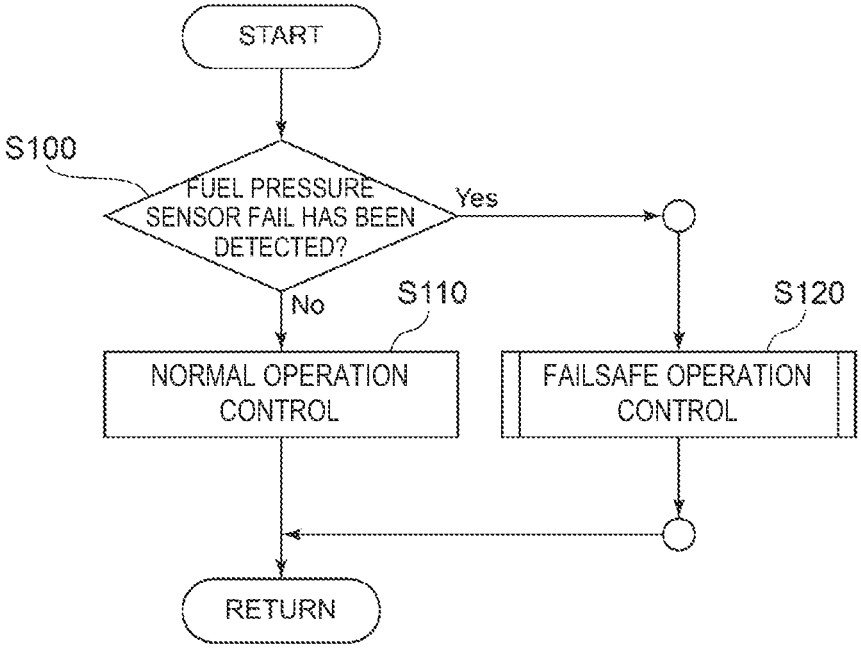
FIG. 6 shows a flowchart of driving control processing in the fuel supply apparatus according to the first embodiment.
Figure 7:
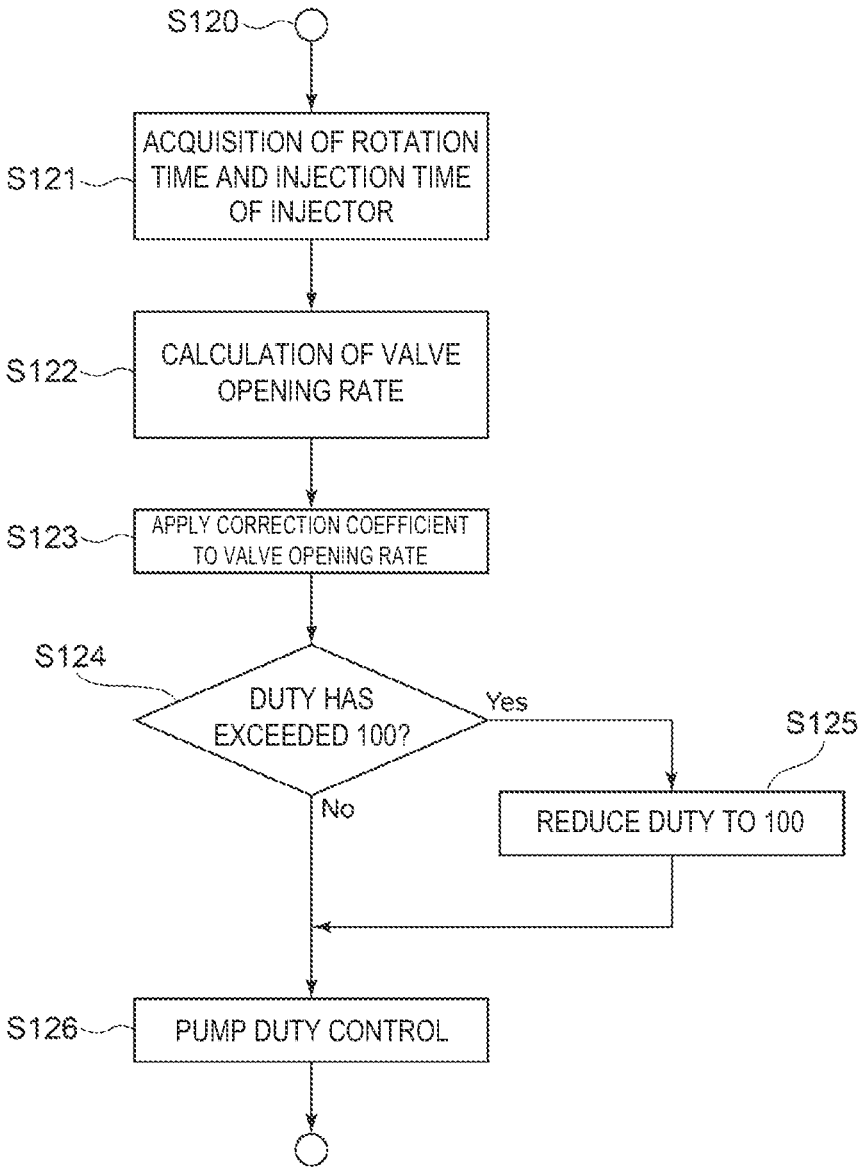
FIG. 7 shows a processing flow of a driving control operation for the fuel pump in the case in which fuel pressure sensor fail is detected.
Figure 8:
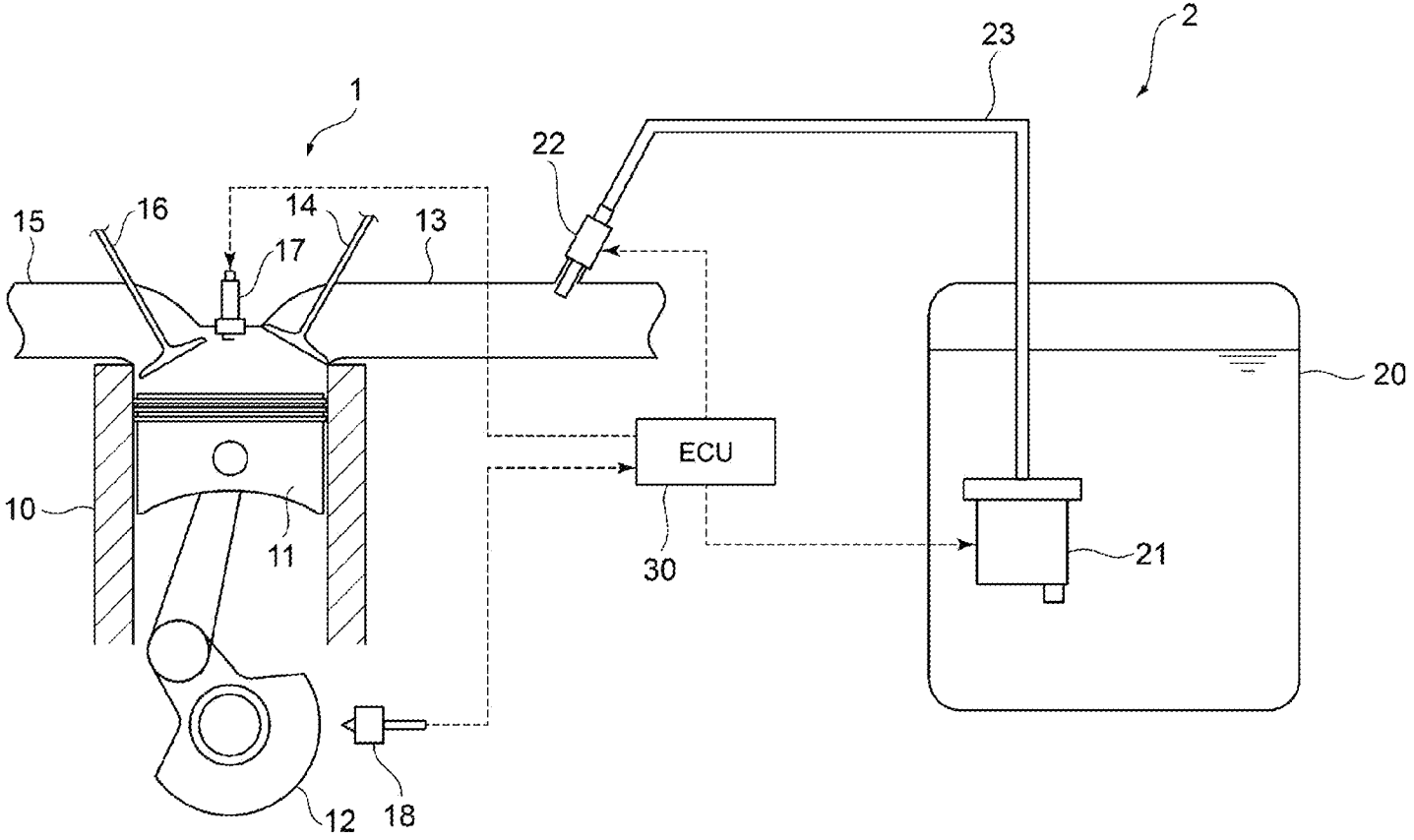
FIG. 8 shows a schematic configuration of an internal combustion engine and a fuel supply apparatus according to a second embodiment.
Figure 9:
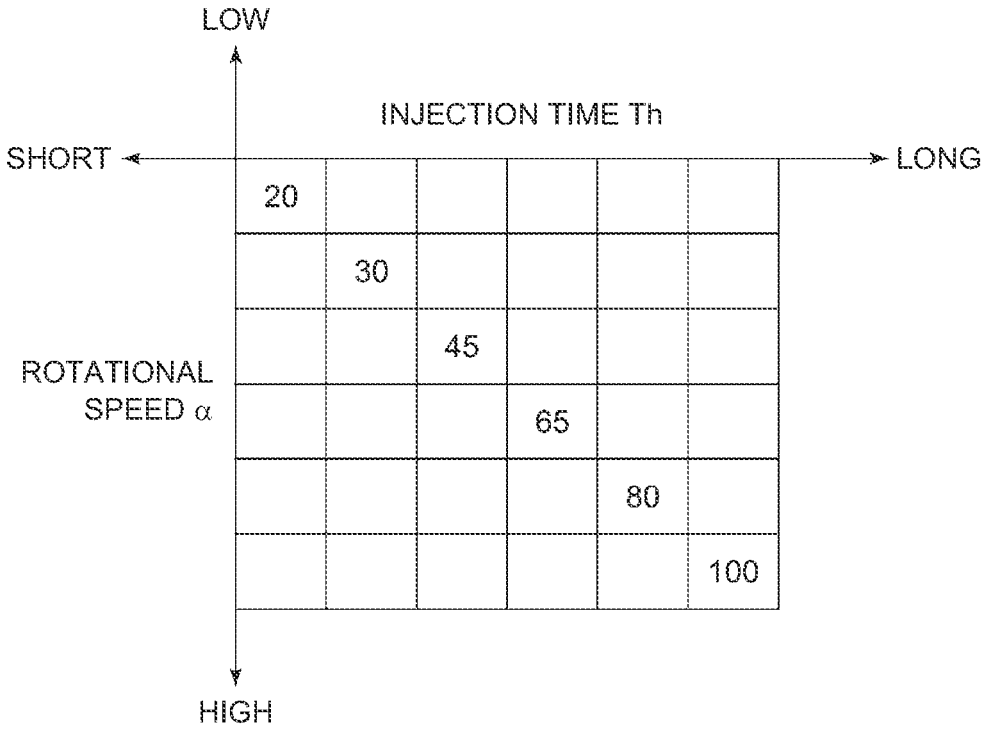
FIG. 9 shows an example of a 3D map.

FIG. 6 is a flowchart of driving control processing in the fuel supply apparatus in the present embodiment. FIG. 7 is a flowchart of driving control processing for the fuel pump executed in failsafe operation control. The driving control processing for the fuel pump in the fuel supply apparatus in the present embodiment is explained with reference to FIGS. 1 and 2 and FIGS. 6 and 7.

Processing in the flowchart shown in FIG. 6 is started when an ignition switch of a vehicle is turned on and is repeatedly executed in every predetermined time until the ignition switch is turned off.

As shown in FIG. 6, in the fuel supply apparatus in the present embodiment, in step S100, the ECU 30 determines whether the fuel-pressure detecting unit 31 has detected fuel pressure sensor fail. When determining that the fuel-pressure detecting unit 31 has not detected fuel pressure sensor fail (S100: No), the ECU 30 performs normal operation control (step S110).

When determining that the fuel-pressure detecting unit 31 has detected fuel pressure sensor fail (S100: Yes), the ECU 30 shifts to failsafe operation control shown in FIG. 7 (S120). These processes are repeated in every predetermined time.

In the failsafe operation control shown in FIG. 7, first, in step S121, processing for acquiring a rotation time of the crankshaft in one air intake unit and an injection time of the injector in one air intake unit is executed.

In step S121, the rotation-time acquiring unit 32 acquires a rotation required time of the crankshaft 12 per one air intake according to a detection signal from the pulser 18. The injection-time acquiring unit 33 acquires an injection time of the injector 22 per one air intake. In the case of the four-cycle engine, the rotation required time of the crankshaft 12 per one air intake is a time required by the crankshaft 12 to rotate twice.

In step S122, the driving control unit 34 calculates an injector valve opening rate, which is an injection time of the injector per unit time, using values acquired in step S121.

In step S123, the driving control unit 34 applies a correction coefficient to the injector valve opening rate calculated in step S122 and calculates a duty ratio of the fuel pump 21.

In step S124, the driving control unit 34 determines whether the duty ratio calculated in step S123 has exceeded 100. Control with the duty ratio exceeding 100 is practically impossible. Therefore, step S124 is a process for excluding practically impossible outcomes.

When determining in step S124 that the duty ratio has exceeded 100 (S124: Yes), in step S125, the driving control unit 34 reduces the duty ratio to 100 (step S125).

When determining in step S124 that the duty ratio has not exceeded 100 (S124: No), the driving control unit 34 controls the fuel pump 21 to set the duty ratio to the duty ratio calculated in step S123 (step S126).

By repeating, in every unit time, the steps explained with reference to FIG. 7, it is possible to perform control to supplement, with the fuel pump 21, the fuel injected by the injector 22. Therefore, a fuel amount in the fuel pipe 23 is kept constant and a fuel pressure in the fuel pipe 23 is kept constant.

With the driving control device for the fuel pump in the present embodiment, irrespective of a simple configuration, it is possible to properly control the fuel pump such that the operation state is maintained even during the fuel pressure sensor fail.

Second Embodiment

FIG. 7 shows a schematic configuration of the internal combustion engine 1 and the fuel supply apparatus 2 according to a second embodiment. Hereinafter, the same components as the components in the first embodiment are denoted by the same reference signs and explanation of the components is omitted.

The fuel supply apparatus 2 in the first embodiment includes the fuel pressure sensor 24 (see FIG. 1). In the normal operation state, the fuel supply apparatus 2 performs the driving control for the fuel pump 21 using the fuel pressure detected by the fuel pressure sensor 24. However, the fuel supply apparatus 2 in the present embodiment is not provided with the fuel pressure sensor 24 and performs, as the normal operation, operation during the fuel pressure sensor fail explained in the first embodiment. That is, in the fuel supply apparatus 2 in the present embodiment, the ECU 30 does not perform the processing (S100) for determining detection of fuel pressure sensor fail shown in FIG. 6 and performs, as the normal operation, driving control processing for the fuel pump explained with reference to FIG. 7. The ECU 30 starts the processing shown in FIG. 7 at the timing when the ignition switch is turned on and repeats the processing in every predetermined time.

With the fuel supply apparatus in the present embodiment, it is possible to properly control the fuel pump such that the operation state is maintained with a simple configuration without using a pressure regulator and a fuel pressure sensor.

The invention claimed is:

1. A driving control device for a fuel pump, comprising:

a valve-opening-rate calculating unit configured to calculate an injector valve opening rate, which is an injection time of an injector per unit time;

a driving control unit configured to set a voltage duty ratio of a driving voltage that should be applied to the fuel pump that supplies fuel in a fuel tank to a fuel pipe communicating with the injector; and wherein the driving control unit is further configured to set the voltage duty ratio to a value that is proportional to the injector valve opening rate calculated via the valve-opening-rate calculating unit.

2. The driving control device for the fuel pump according to claim 1, wherein:

the valve-opening-rate calculating unit includes a rotation-time acquiring unit configured to acquire a rotation time of a crankshaft per one air intake;

the valve-opening-rate calculating unit further includes an injection-time acquiring unit configured to acquire an injection time of the injector per one air intake; and the valve-opening-rate calculating unit is further configured to calculate the injector valve opening rate via dividing the injection time of the injector per one air intake acquired via the injection-time acquiring unit by the rotation time of the crankshaft per one air intake acquired via the rotation-time acquiring unit.

3. The driving control device for the fuel pump according to claim 2, wherein the injection time of the injector per one air intake is an injector driving time in which a driving voltage is applied to the injector per one air intake.

4. The driving control device for the fuel pump according to claim 2, wherein the injection time of the injector per one air intake is an actual valve opening time determinable via subtracting an ineffective injection time, during which the fuel is not injected from the injector even though a driving voltage is applied in one air intake, from an injector driving time during which a driving voltage is applied to the injector per one air intake.

5. The driving control device for the fuel pump according to claim 1, wherein the unit time is a fixed value that is one of equal to and larger than a rotation time of a crankshaft per one air intake at engine rotations per minute (rpm) during idling.

6. The driving control device for the fuel pump according to claim 1, wherein the driving control unit is further configured to:

determine whether a detection result of a fuel pressure sensor, which detects pressure in the fuel pipe, is usable;

when the detection result of the fuel pressure sensor is usable, set the voltage duty ratio according to the detection result; and when the detection result of the fuel pressure sensor is not usable, set the voltage duty ratio to a value proportional to the injector valve opening rate per unit time.

7. The driving control device for the fuel pump according to claim 1, further comprising a fuel-pressure detecting unit configured to detect failure of a fuel pressure sensor structured and arranged to detect a fuel pressure in the fuel pipe.

8. The driving control device for the fuel pump according to claim 1, wherein the driving control unit is further configured to determine a calculated voltage duty ratio based on a correction coefficient and the injector valve opening rate calculated via the valve-opening-rate calculating unit.

9. The driving control device for the fuel pump according to claim 8, wherein the driving control unit is further configured to:

determine whether the calculated voltage duty ratio exceeds 100;

set the voltage duty ratio according to the calculated voltage duty ratio when the calculated voltage duty ratio is one of equal to and less than 100; and set the voltage duty ratio to 100 when the calculated voltage duty ratio is greater than 100.

10. The driving control device for the fuel pump according to claim 9, wherein the correction coefficient is dependent on a fuel supply ability of the fuel pump and a fuel injection ability of the injector.

11. A fuel supply apparatus, comprising:

a rotation time sensor configured to detect a rotation time of a crankshaft per one air intake;

an injector;

a fuel pipe communicating with the injector;

a fuel pump structured and arranged to supply fuel in a fuel tank to the fuel pipe;

a driving control device for the fuel pump, the driving control device including a valve-opening-rate calculating unit and a driving control unit;

the valve-opening-rate calculating unit configured to calculate an injector valve opening rate, which is an injection time of the injector per unit time;

the driving control unit configured to set a voltage duty ratio of a driving voltage that should be applied to the fuel pump; and wherein the driving control unit is further configured to set the voltage duty ratio to a value that is proportional to the injector valve opening rate calculated via the valve-opening-rate calculating unit.

12. The fuel supply apparatus according to claim 11, wherein:

the valve-opening-rate calculating unit includes a rotation-time acquiring unit configured to acquire a rotation time of a crankshaft per one air intake;

the valve-opening-rate calculating unit further includes an injection-time acquiring unit configured to acquire an injection time of the injector per one air intake; and the valve-opening-rate calculating unit is further configured to calculate the injector valve opening rate via dividing the injection time of the injector per one air intake acquired via the injection-time acquiring unit by the rotation time of the crankshaft per one air intake acquired via the rotation-time acquiring unit.

13. The fuel supply apparatus according to claim 12, wherein the injection time of the injector per one air intake is an injector driving time in which a driving voltage is applied to the injector per one air intake.

14. The fuel supply apparatus according to claim 12, wherein the injection time of the injector per one air intake is an actual valve opening time determinable via subtracting an ineffective injection time, during which the fuel is not injected from the injector even though a driving voltage is applied in one air intake, from an injector driving time during which a driving voltage is applied to the injector per one air intake.

15. The fuel supply apparatus according to claim 11, wherein the unit time is a fixed value that is one of equal to and larger than a rotation time of a crankshaft per one air intake at engine rotations per minute (rpm) during idling.

16. The fuel supply apparatus according to claim 11, further comprising a fuel pressure sensor structured and arranged to detect a fuel pressure in the fuel pipe, wherein the fuel pressure sensor is communicatively connected to the driving control device.

17. The fuel supply apparatus according to claim 16, wherein the driving control unit is further configured to:

determine whether a detection result of the fuel pressure sensor is usable;

when the detection result of the fuel pressure sensor is usable, set the voltage duty ratio according to the detection result; and when the detection result of the fuel pressure sensor is not usable, set the voltage duty ratio to a value proportional to the injector valve opening rate per unit time.

18. The fuel supply apparatus according to claim 11, wherein the driving control unit is further configured to determine a calculated voltage duty ratio based on a correction coefficient and the injector valve opening rate calculated via the valve-opening-rate calculating unit.

19. The fuel supply apparatus according to claim 18, wherein the driving control unit is further configured to:

determine whether the calculated voltage duty ratio exceeds 100;

set the voltage duty ratio according to the calculated voltage duty ratio when the calculated voltage duty ratio is one of equal to and less than 100; and set the voltage duty ratio to 100 when the calculated voltage duty ratio is greater than 100.

20. The fuel supply apparatus according to claim 18, wherein the correction coefficient is dependent on a fuel supply ability of the fuel pump and a fuel injection ability of the injector.

* * * * *